United States Patent [19]

Oka et al.

[11] 4,257,179

[45] Mar. 24, 1981

[54] ITEM LIST SETTING MECHANISM IN AN ITEM SELECTION SIGNAL INPUT SYSTEM

[75] Inventors: Takashi Oka, Yamatokoriyama; Hiroshi Morimoto, Sakurai, both of Japan

[73] Assignee: Sharp Kabushiki Kaisha, Osaka, Japan

[21] Appl. No.: 26,567

[22] Filed: Apr. 3, 1979

[30] Foreign Application Priority Data

Apr. 7, 1978 [JP] Japan ..... 53-41479

[51] Int. Cl.[3] ..... B42F 17/34; G09F 11/02

[52] U.S. Cl. ..... 40/378; 40/467; 40/475; 340/365 VL

[58] Field of Search ..... 40/378, 377, 379, 467, 40/475; 235/145 R, 145 A, 146; 340/712, 365 VL; 35/5, 6

[56] References Cited

U.S. PATENT DOCUMENTS

| | | | |
|---|---|---|---|
| 2,552,448 | 5/1951 | Ortendahl | 40/378 |
| 2,710,471 | 6/1955 | Staunton et al. | 40/475 |
| 2,995,726 | 8/1961 | Rickard | 340/365 VL |
| 3,100,351 | 8/1963 | Priednieks et al. | 35/6 |
| 3,187,321 | 6/1965 | Kameny | 340/712 X |
| 3,717,870 | 2/1973 | Mathews et al. | 340/365 VL |
| 3,747,245 | 7/1973 | Ladine | 40/379 |
| 3,757,322 | 9/1973 | Barkan et al. | 35/6 X |
| 3,760,360 | 9/1973 | Reynolds et al. | 340/365 VL |
| 4,067,006 | 1/1978 | Saylor et al. | 40/467 X |

OTHER PUBLICATIONS

Cummings, IBM Technical Disclosure, "Variable Keyboard for Terminal Displays " vol. 16, No. 2, 7/1973.

*Primary Examiner*—John F. Pitrelli
*Assistant Examiner*—G. Lee Skillington
*Attorney, Agent, or Firm*—Birch, Stewart, Kolasch & Birch

[57] ABSTRACT

An item selection signal input system comprising a keyboard panel including a plurality of matrix aligned, transparent touch sensitive switches. An item list setting mechanism is provided for placing a desired item list below the keyboard panel in order to mark each of the touch sensitive switches. The item list setting mechanism comprises an item list carrying drum to which one end of a plurality of item lists are fixed. The desired item list is selected while the item list carrying drum is driven to rotate.

12 Claims, 14 Drawing Figures

ITEM LIST SETTING MECHANISM IN AN ITEM SELECTION SIGNAL INPUT SYSTEM

BACKGROUND AND SUMMARY OF THE INVENTION

The present invention relates to an item selection signal input system, which comprises a keyboard panel including a plurality of switches corresponding to items to be selected.

The present invention relates, more particularly, to an item list setting mechanism for placing a desired item list carrying a plurality of key indicia under a keyboard panel in order to mark each of the switches included in the keyboard panel of the item selection signal input system.

The item selection signal input system can be connected to a data processing system for selecting a desired item stored in the data processing system. The data processing system performs a desire calculation operation on the data corresponding to the item selected by the item selection signal input system.

In such a system, the number of the items stored in the data processing system can be considered unlimited. However, the number of items selectable through the item selection signal input system is limited by the number of switches included in the keyboard panel of the item selection signal input system. To increase the item number selectable through the keyboard panel, it has been proposed to assign a plurality of indicia to each of the switches included in the keyboard panel.

Accordingly, an object of the present invention is to provide a novel keyboard panel suited for the item selection signal input system.

Another object of the present invention is to provide a mechanism for selectively marking each of the switches included in a keyboard panel of the item selection signal inut system by different indicia.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a keyboard panel of the item selection signal input system comprises a matrix switch panel including a plurality of transparent touch sensitive switches. An item list carrying a plurality of indicia at positions corresponding to each of the touch sensitive switches is positioned below the keyboard panel in order to mark each of the switches.

A plurality of the item lists are secured around a rotatable drum. A desired item list is selected by rotating the drum, and the selected item list is positioned under the keyboard panel to mark each of the touch sensitive switches with desired indicia.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
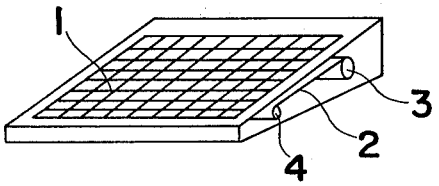
FIG. 1 is a perspective view of a basic construction of an item selection signal input system of the present invention.

FIG. 1 schematically shows a basic construction of an item selection signal input system of the present invention.

The item selection signal input system mainly comprises a keyboard panel 1 and an item list 2. The keyboard panel 1 comprises a plurality of matrix aligned, transparent touch sensitive switches. The item list 2 can be secured on a strip which is wound around a pair of rollers 3 and 4. A desired item list 2 is positioned under the keyboard panel 1 to provide indicia for each of the touch sensitive switches included in the keyboard panel 1. A plurality of the item lists can be secured on the strip to provide different kinds of indicia for each of the switches.

FIGS. 2 through 5 show a basic construction of an item list setting mechanism of the present invention.

Figure 2:
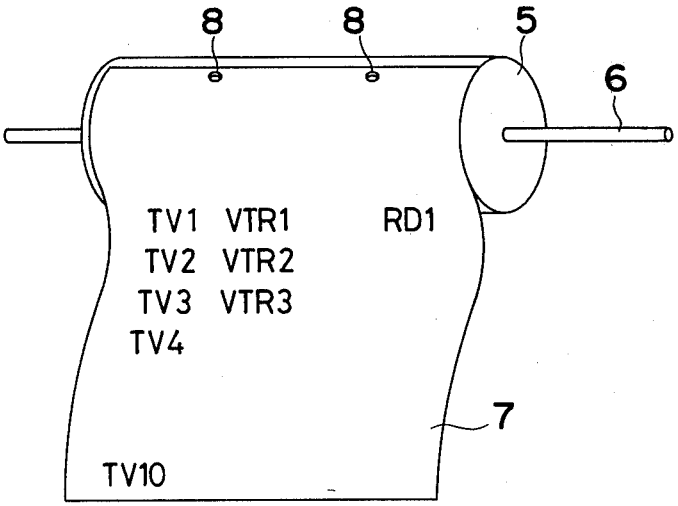
FIG. 2 is a perspective view of an item list carrying drum included in the item selection signal input system of the present invention.
Figure 3:
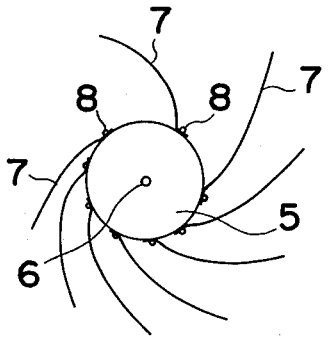
FIG. 3 is a side view of the item list carrying drum of FIG. 2.

To provide different indicia for each of the switches, in accordance with the present invention, a plurality of item lists 7 are secured around a drum 5 which is driven to rotate via a driving shaft 6. More specifically, each of the item lists 7 is provided with desired markings as shown in FIG. 2. The marking positions correspond to the location of each of the touch sensitive switches included in the keyboard panel 1. The plurality of item lists 7 are secured to the drum 5 through the use of screws 8 at one end thereof with predetermined intervals as shown in FIG. 3.

Figure 4:
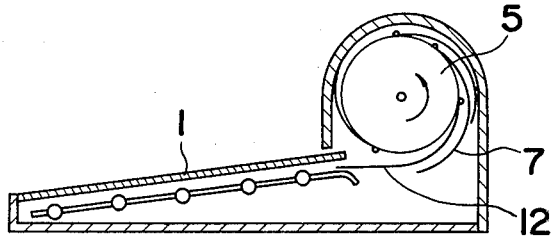
FIGS. 4 and 5 are sectional views showing a basic operation of an item list setting mechanism included in the item selection signal input system of the present invention.
Figure 5:
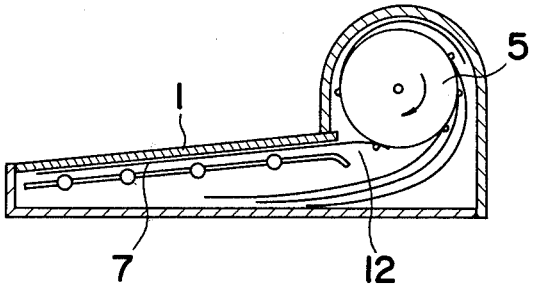
Figure 6:
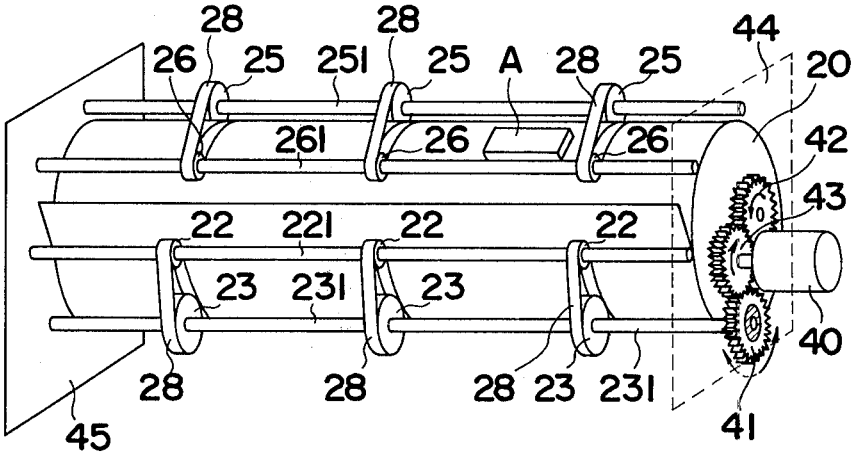
FIG. 6 is a perspective view of an essential part of an embodiment of an item list setting mechanism of the present invention.
Figure 7:
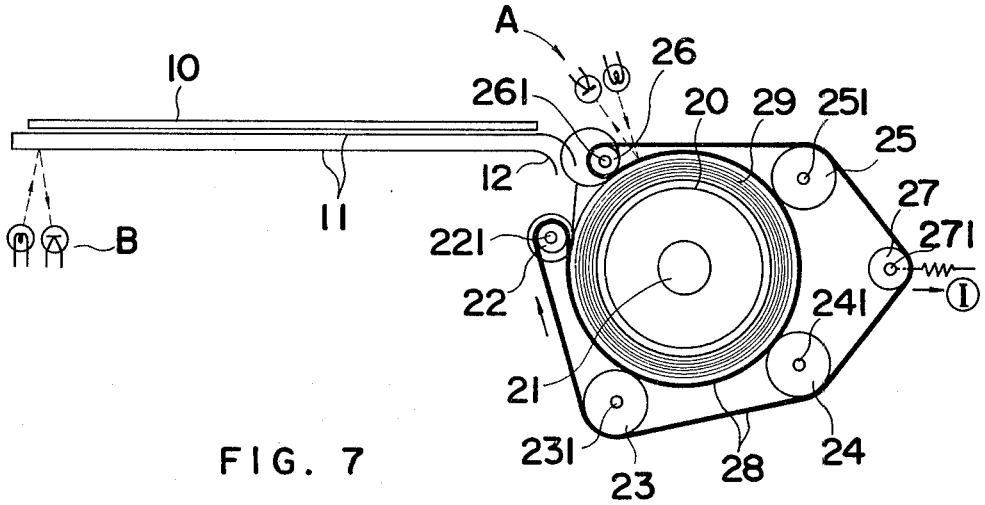
FIG. 7 is a sectional view of the item list setting mechanism of FIG. 6.

A desired item list 7 is selected by rotating the drum 5 in a direction shown by an arrow of FIG. 4, and then the thus selected item list 7 is inserted into a space 12 formed under the keyboard panel 1 by reversely rotating the drum 5 as shown by an arrow of FIG. 5. FIGS. 6 and 7 show an embodiment of an item list setting mechanism of the present invention.

Figure 8:
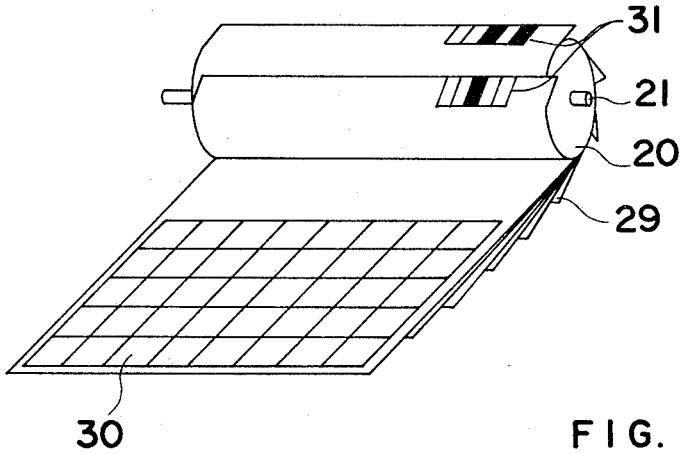
FIG. 8 is a perspective view of an item list carrying drum included in the item list setting mechanism of FIG. 6.

An item list carrying drum 20 is supported by a driving shaft 21, which is rotatably secured to side walls 44 and 45 of the housing of the item selection signal input system. A plurality of item lists 29 are fixed to the item list carrying drum 20 at one end thereof and wound around the item list carrying drum 20 as shown in FIG. 8. Each of the item list 29 is provided with markings 30 formed at positions corresponding to and registering with each of the switches of the keyboard panel for marking the switches with corresponding items.

A plurality of roller shafts 221, 231, 241, 251 and 261 are supported by the side walls 44 and 45, and positioned around the item list carrying drum 20 with a predetermined distance from the periphery of the item list carrying drum 20. A movable roller shaft 271 is slidably secured in a direction I as shown in FIG. 7. A plurality of rollers 22 are secured to the roller shaft 221 so that the rollers 22 contact the item lists 29. In a same way, rollers 23, 24, 25, 26 and 27 are secured to the roller shafts 231, 241, 251, 261 and 271, respectively.

Endless guides belts 28 are extended across the rollers 22, 23, 24, 25, 26 and 27 so that the endless guide belts 28 contacts the item lists 29 except for an outlet portion for extracting a selected item list 29 toward a keyboard panel 10.

The driving shaft 21 is connected to a motor 40 through a driving gear 43 and a transfer gear 42. That is, the item list carrying drum 20 is driven to rotate in response to rotation of the motor 40. A transfer gear 41 including a one-way clutch mechanism is secured to the roller shaft 231. This provides a third drive means for rotating the guide belts 28. The transfer gear 41 is geared to the driving gear 43.

Figure 10:
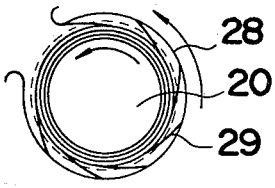

More specifically, when the item list carrying drum 20 is driven to rotate in a direction shown by an arrow of FIG. 10, wherein the selected item list 29 is driven to travel toward the keyboard panel 10, the endless guide belts 28 are driven to rotate in a direction shown by an arrow of FIG. 10 at a velocity higher than the peripheral velocity of the item list 29 via the one-way clutch transfer gear 41.

Figure 9:
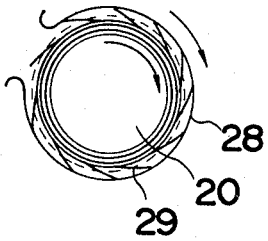
FIGS. 9 through 12 are sectional views for explaining an operation of the item list setting mechanism of FIG. 6.

To the contrary, when the item list carrying drum 20 is driven to rotate in a direction shown by the arrow in FIG. 9 for selection purposes, the transfer gear 41 is disconnected from the driving gear 43 because of the one-way clutch mechanism. Under these conditions, the endless guide belts 28 rotate in the direction shown by the arrow in FIG. 9 due to friction caused by the item lists 29.

Figure 11:
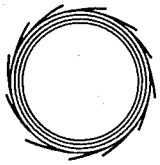
Figure 12:
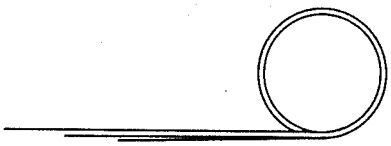

The movable roller shaft 271 functions to absorb clearances formed between the item list carrying drum 20 and the rollers 22 through 26. More specifically, when all of the item lists 29 are wound around the item list carrying drum 20 as shown in FIG. 11, the endless guide belts 28 are held to contact with the peripheries of the rollers 22 through 26 at the surfaces confronting the item list carrying drum 20. When the item list 29 is extracted toward the keyboard panel 10 as shown in FIG. 12, the endless guide belts 28 are spaced apart from the rollers 22 through 26, and contact the periphery of the item list carrying drum 20.

A pair of guide plates 11 are installed under the keyboard panel 10 as shown in FIG. 7 to facilitate the travel of the item list 29. The guide plates 11 comprises transparent plates and include an inlet opening 12 for introducing the selected item list 29. As already discussed, the keyboard panel 10 includes a plurality of matrix aligned touch sensitive transparent switches.

A page detection optical sensor "A" is disposed near the inlet opening 12 for sensing a page code 31 recorded on the rear surface of the item list 29. Another page detection optical sensor "B" is located below the keyboard panel 10 for confirmation purposes.

When a page selection command is introduced through the keyboard panel 10, the motor 40 is activated to rotate the item list carrying drum 20 in the direction shown by the arrow of FIG. 9. This rotation corresponds to the rotation of the first drive means. The endless guide belts 28 are caused to rotate due to the friction created by the item lists 29. That is, the rotation velocity of the endless guide belts 28 is slightly slower than the peripheral velocity of the item lists 29.

When a desired page code 31 is detected by the page detection optical sensor "A", the rotation of the motor 40 is terminated. Thereafter, the motor 40 is driven to rotate in the counter direction. This rotation corresponds to the rotation of the second drive means. The item list carrying drum 20 and the endless guide belts 28 are driven to rotate in the direction shown by the arrows of FIG. 10. The rotating velocity of the endless guide belts 28 is faster than the peripheral velocity of the item lists 29, whereby the selected item list 29 is introduced into the clearance formed between the pair of guide plates 11.

When the leading edge of the thus selected and extracted item list 29 reaches the page detection optical sensor "B", the revolution of the motor 40 is controlled to terminate. Under these conditions, the operator recognizes the item markings 30 through the touch sensitive transparent switches.

Figure 14:
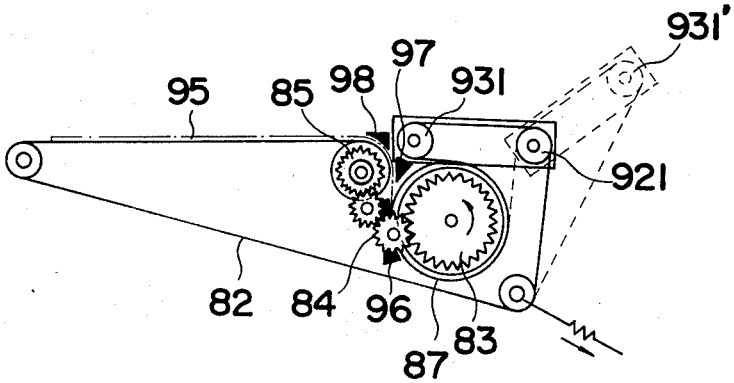
FIG. 14 is a sectional view of the item list setting mechanism of FIG. 13.
Figure 13:
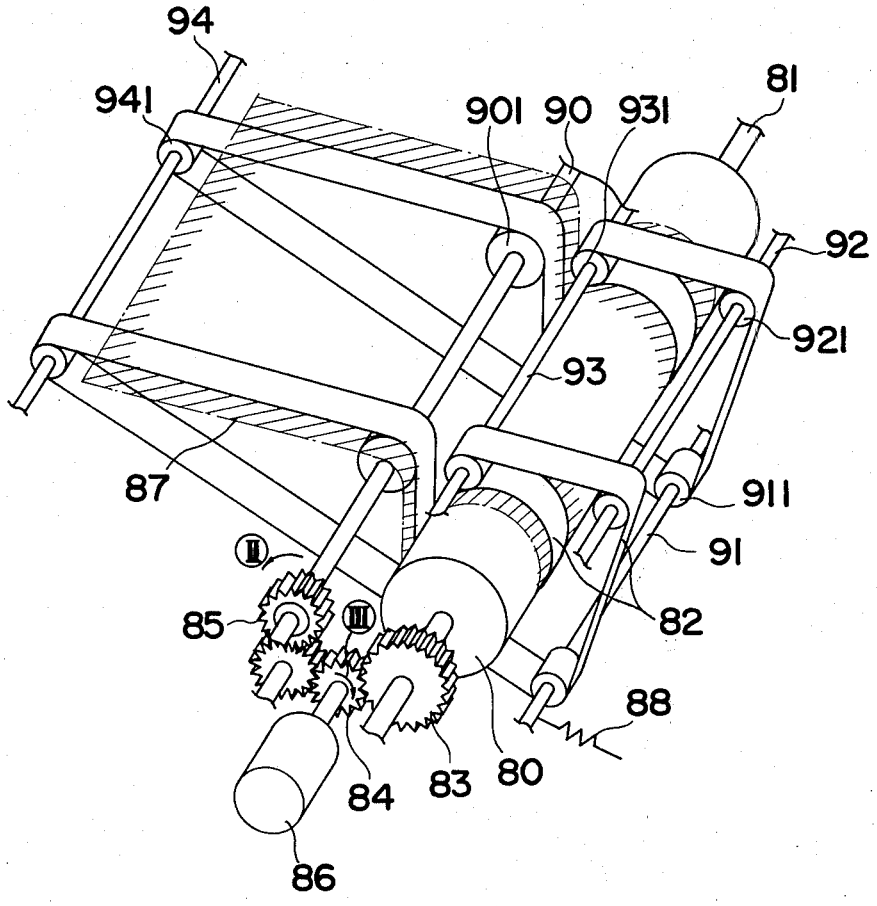
FIG. 13 is a perspective view of another embodiment of the item list setting mechanism of the present invention.

FIGS. 13 and 14 show another embodiment of an item list setting mechanism of the present invention.

In this embodiment, the endless guide belts are extended to below the keyboard panel instead of the provision of the guide plates 11.

An item list carrying drum 80 is fixed to a driving shaft 81. A plurality of item lists 87 are secured to the item list carrying drum 80 at one end thereof. The driving shaft 81 is connected to a motor 86 via a driving gear 84 and a transfer gear 83. Roller shafts 92 and 93, and a movable roller shaft 91, which is biased outward by a spring 88, are disposed around the item list carrying drum 80. Additional roller shafts 90 and 94 are disposed below a keyboard panel 95.

Rollers 901 are secured to the roller shaft 90. Similarly, rollers 911, 921, 931 and 941 are secured to the roller shafts 91, 92, 93 and 94. Endless guide belts 82 are extended across these rollers so that the guide belts 82 contact the periphery of the item list carrying drum 80 as shown in FIGS. 13 and 14.

The roller shaft 90 is connected to a one-way clutch transfer gear 85, which is associated with the driving gear 84. The rotation of the transfer gear 85 is transmitted to the roller shaft 90 when the transfer gear 85 rotates in a direction (II) shown by an arrow in FIG. 13. When the transfer gear 85 rotates in the counter direction, the rotation of the roller shaft 90 is free from the rotation of the transfer gear 85.

During the page selection operation, the driving gear 84 is driven to rotate in a direction (III) shown in FIG. 13. That is, the item list carrying drum 80 is driven to rotate in the counter-clockwise direction. At this moment, the roller shaft 90 is free from the rotation of the transfer gear 85. The guide belts 82 rotate due to the friction caused by the rotating item lists 87.

When a desired page is selected, the motor 86 is driven to rotate in the counter direction. The item list carrying drum 80 is driven to rotate in the clockwise direction. At this moment, the roller shaft 90 is driven to rotate by the transfer gear 85, thereby extracting the selected item list 87 along the guide belts 82 toward the keyboard panel 95. The gear ratio is selected so that the movement of the guide belts 82 under the extraction operation is faster than the peripheral speed of the item list carrying drum 80.

The roller shaft 93 is rotatable around the roller shaft 92 as shown by broken lines in FIG. 14, whereby the item lists 87 can be exchanged. Guide members 96, 97 and 98 are provided to ensure smooth movement of the item lists 87.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A key input system comprising:

a keyboard panel including a plurality of switches;

a plurality of item lists, each of which is provided with item markings at positions corresponding to said switches;

an item list carrying drum operatively mounted adjacent to said keyboard panel for supporting said plurality of item lists;

first drive means for rotating said item list carrying drum in a first direction, wherein said plurality of item lists are wound around said item list carrying drum;

means for selecting and locating a desired item list while said item list carrying drum is driven to rotate in said first direction by said first drive means;

second drive means for rotating said item list carrying drum in a second direction in response to completion of the selecting and locating operation, wherein one of said plurality of item lists is extracted from said item list carrying drum;

guide means for guiding said selected item list toward said keyboard panel when said item list carrying drum is driven to rotate in said second direction; and positioning means for locating said selected item list at a position corresponding to said keyboard panel, thereby registering each switch included in said keyboard panel to said selected item list.

2. A key input system of claim 1, wherein said keyboard panel comprises a plurality of matrix-aligned, transparent touch sensitive switches.

3. A key input system of claim 2, wherein said item list is guided to a space formed below said keyboard panel by said guide means when said item list carrying drum is driven to rotate in said second direction.

4. A key input system of claim 1, wherein said selecting and locating operation includes a sensor for selecting a desired item list supported by said item list carrying drum while said item list carrying drum is driven to rotate in said first direction.

5. A key input system of claim 1, 2, 3 or 4, further comprising an endless belt disposed around said item list carrying drum, said endless belt being held in contact with free ends of said plurality of said item lists supported by said item list carrying drum.

6. A key input system of claim 5, further comprising third drive means for moving said endless belt in said second direction around said item list carrying drum when said item list carrying drum is driven to rotate in said second direction.

7. A key input system of claim 6, wherein said movement of said endless belt in said second direction is faster than the peripheral speed of said item list carrying drum.

8. A key input system of claim 6, wherein said endless belt extends below said keyboard panel.

9. A key input system comprising:

a keyboard panel including a plurality of switches;

a plurality of item lists, each of which is provided with item indicia at positions corresponding to said switches;

an item list carrying drum operatively mounted adjacent to said keyboard panel for supporting said plurality of item lists;

first drive means for rotating said item list carrying drum in a first direction, wherein said plurality of item lists are wound around said item list carrying drum;

second drive means for rotating said item list carrying drum in a second direction, wherein said plurality of item lists are extracted from said item list carrying drum; and guide means for guiding the item list underneath said keyboard panel when said item list carrying drum is driven to rotate in said second direction;

wherein a selected item list is operatively positioned relative to said keyboard panel when said drum is rotated in the second direction to register of individual keyboard panel switches with said selected item list.

10. A key input system of claim 9, wherein said keyboard panel comprises a plurality of matrix aligned, transparent touch sensitive switches.

11. A key input system of claim 9 and further including a means for selecting and locating a desired item list, said list having a sensor for selecting a desired item list supported by said item list carrying drum while said item list carrying drum is driven to rotate in said first direction.

12. A key input system according to claim 1 or 9, wherein said plurality of item lists are removable mounted to said list carrying drum.

* * * * *